US008087722B2

(12) United States Patent
Hung

(10) Patent No.: US 8,087,722 B2
(45) Date of Patent: Jan. 3, 2012

(54) ARMCHAIR WITH A STORAGE DEVICE

(76) Inventor: Yu-Ching Hung, Taichung (TW)

( * ) Notice: Subject to any disclaimer, the term of this patent is extended or adjusted under 35 U.S.C. 154(b) by 115 days.

(21) Appl. No.: 12/647,485

(22) Filed: Dec. 26, 2009

(65) Prior Publication Data

US 2011/0156456 A1 Jun. 30, 2011

(51) Int. Cl.
*A47C 7/62* (2006.01)

(52) U.S. Cl. ..... 297/188.19; 297/188.14; 297/188.01

(58) Field of Classification Search ..... 297/188.01, 297/188.04, 188.07, 188.14–188.16, 188.19
See application file for complete search history.

(56) References Cited

U.S. PATENT DOCUMENTS

| | | | | | |
|---|---|---|---|---|---|
| 1,646,266 | A * | 10/1927 | Stoner | 224/282 |
| 2,765,025 | A * | 10/1956 | Bakalic et al. | 297/188.08 |
| 3,136,578 | A * | 6/1964 | Tihovici | 297/188.16 |
| 4,191,420 | A * | 3/1980 | Fassett et al. | 312/235.6 |
| 4,474,407 | A * | 10/1984 | Nazar | 297/188.13 |
| 4,719,764 | A * | 1/1988 | Cook | 62/261 |
| 5,395,157 | A * | 3/1995 | Rollo et al. | 297/344.26 |
| 6,106,058 | A * | 8/2000 | Sur et al. | 297/188.19 |
| 6,227,615 | B1 * | 5/2001 | Newhouse et al. | 297/188.11 |
| 6,733,073 | B2 * | 5/2004 | Whiteside et al. | 297/188.08 |

* cited by examiner

*Primary Examiner* — Laurie Cranmer

(57) ABSTRACT

An armchair with a storage device, the storage device is disposed in the space between the arm rest and the seat and used to store goods. The user can open and close the storage device very easily while seating in the armchair, making it convenient for the user to store or take out goods. Furthermore, the armchair with a storage device is easy to assemble and simply structured without changing too much the structure of the armchair.

7 Claims, 6 Drawing Sheets

ARMCHAIR WITH A STORAGE DEVICE

BACKGROUND OF THE INVENTION

1. Field of the Invention

The present invention relates to a storage device, and more particularly to an armchair with a storage device.

2. Description of the Prior Art

An armchair conventionally comprises a seat, a back, two armrests and a base. The existing armchairs don't have storage function, and between the armrests and the seat is an unutilized hollow space. The present invention is aimed at efficient utilization of this space between the armrests and the seat without considerably increasing the cost and complicating the structure of the armchair.

SUMMARY OF THE INVENTION

The primary object of the present invention is to provide an armchair with a storage device which can be used to store objects for the user, and the user can open and close the storage device very easily while seating in the armchair.

Another object of the present invention is to provide a lost cost armchair with a storage device which is simply structured without changing too much the structure of the armchair.

To achieve the above objects, an armchair with a storage device comprises: a main body, at least one storage device and at least one armrest. The main body includes a seat, a back and a base. The storage device includes at least one assembling frame and at least one covering board. The assembling frame is disposed at a lateral side of the seat and includes a bottom and at sidewalls at both sides of the bottom, the assembling frame has two ends, at one end of the assembling frame is formed a top surface which is connected between the ends of the two sidewalls; another end of the assembling frame is formed with an assembling hole located between the two sidewalls, the bottom, the two sidewalls and the top surface define a receiving space. The covering board has one end formed with a pivoting end which is pivoted to the two pivots in the assembling hole, and another end of the covering board is formed with an opening and closing end, the receiving space is sealed with the covering board, an edge of the opening and closing end of the covering board abuts against that of the top surface of the assembling frame. The armrest is disposed on the top surface of the assembling frame, and the storage device is fixed to the lateral side of the seat by the assembling frame and the covering board, so that a space between the armrest and the seat is utilized for storage purpose.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
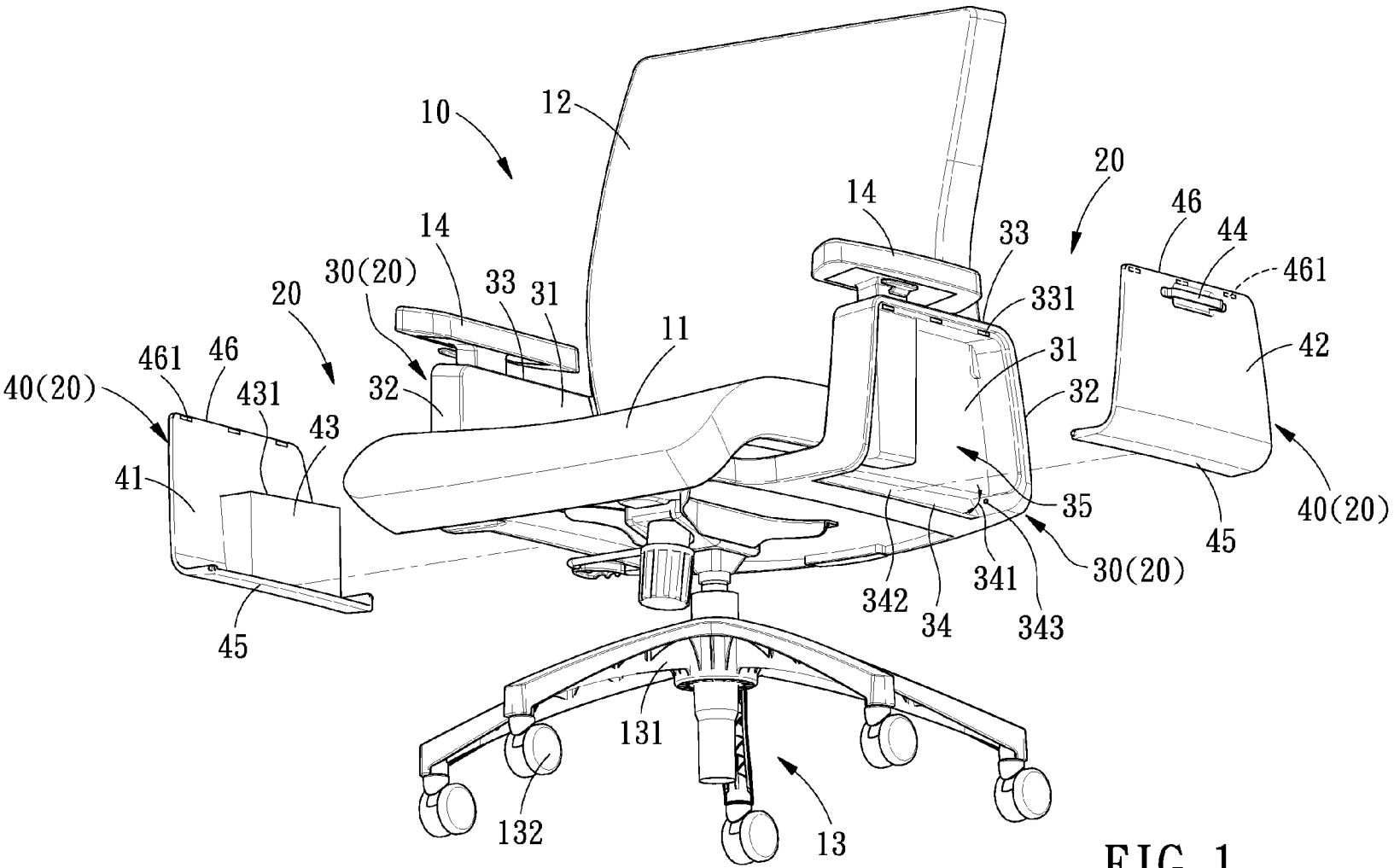
FIG. 1 is an exploded view of an armchair with a storage device in accordance with a first embodiment of the present invention.
Figure 2:
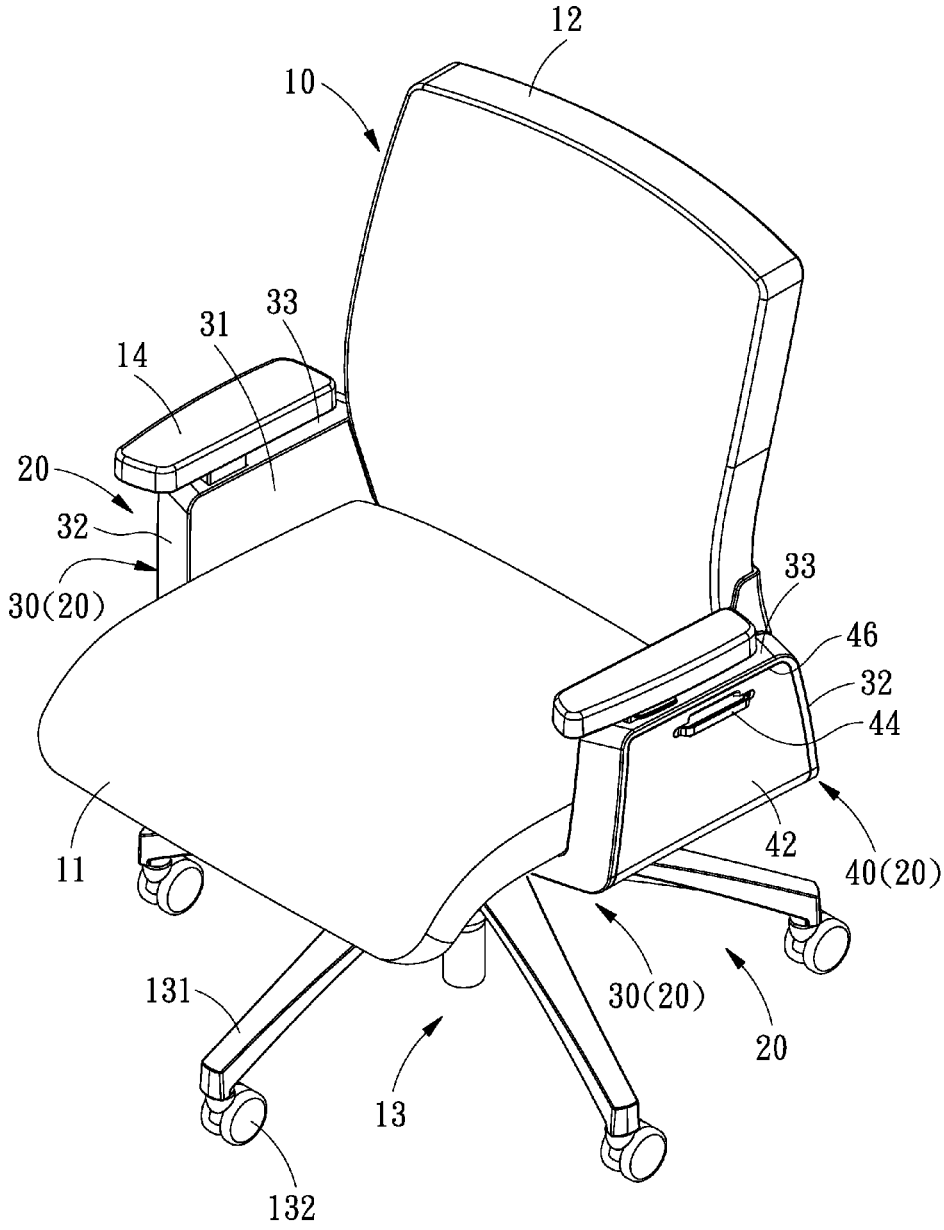
FIG. 2 is a perspective view of the armchair with a storage device in accordance with the first embodiment of the present invention.
Figure 3:
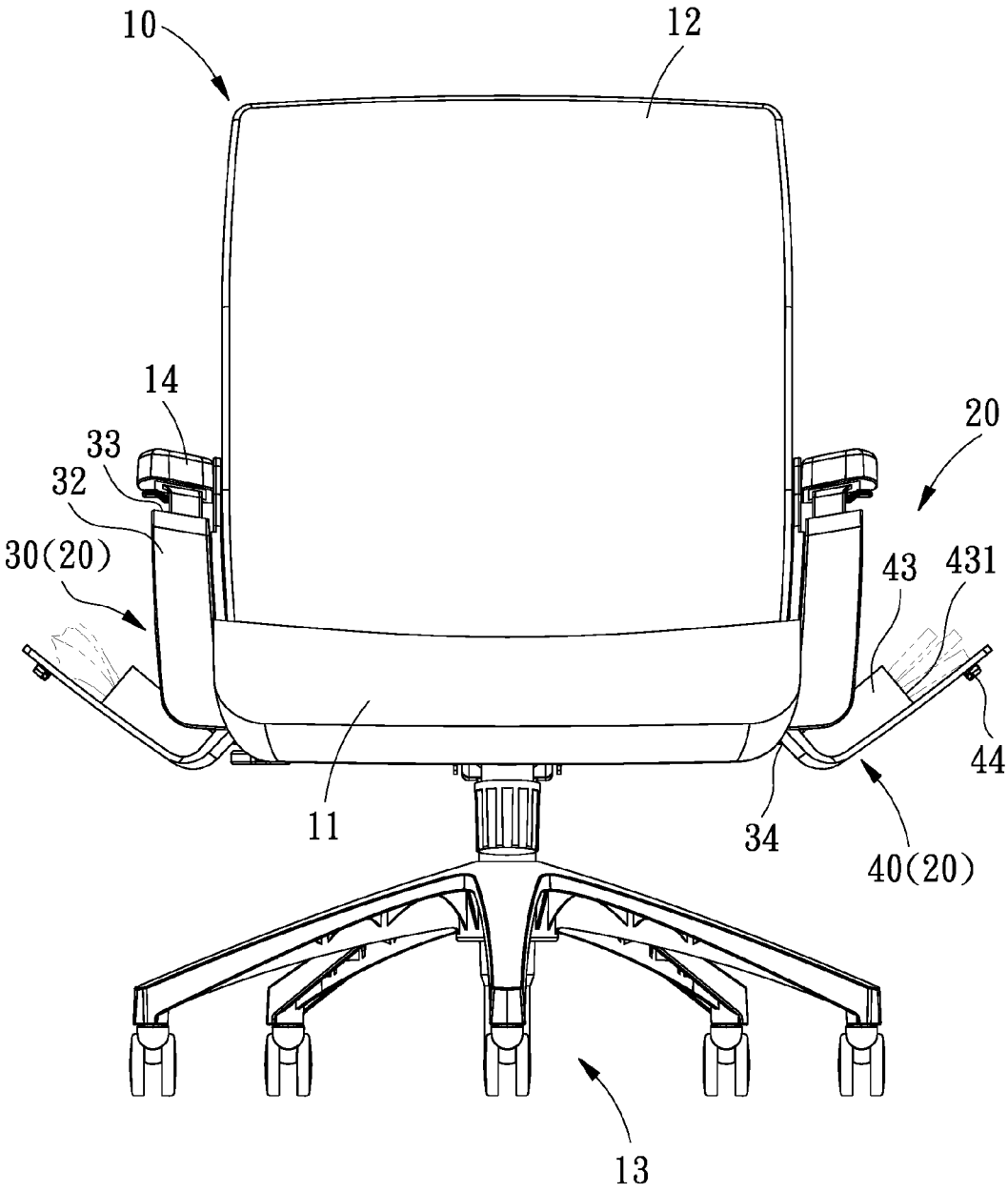
FIG. 3 is an operational view of the armchair with a storage device in accordance with the first embodiment of the present invention.

Referring to FIGS. 1-3, an armchair with a storage device in accordance with the present invention comprises: at least one storage device 20 which consists of at least one assembling frame 30 and at least one covering board 40 which are disposed at lateral sides of a seat 11 of a main body 10 of the armchair. On a top surface 33 of the assembling frame 30 is disposed at least one armrest 14.

The main body 10 of the armchair comprises the seat 11, a back 12 and a base 13. The back 12 is disposed at one lateral side of the seat 11. The base 13 supports the back 12 and the seat 11 and includes a plurality of radially-arranged legs 131, each of which is provided with a wheel 132.

The assembling frame 30 is disposed at a lateral side of the seat 11 and includes a bottom 31 and two sidewalls 32 at both sides of the bottom 31. The assembling frame 30 has two ends, at one end of the assembling frame 30 is formed a top surface 33 which is connected between the ends of the two sidewalls 32. Along the periphery edge of the top surface 33 are arranged a plurality of magnetic members 331. The other end of the assembling frame 30 is formed with an assembling hole 34 located between the two sidewalls 32. In the assembling hole 34 is defined an angle 341, and one side of the angle 341 is extended to form a slanting surface 342. Two pivots 343 are formed in the assembling hole 34 and located at two opposite inner surfaces of the sidewalls 32. The bottom 31, the two sidewalls 32 and the top surface 33 define a receiving space 35.

The covering board 40 includes an inner surface 41 and an outer surface 42. A storage portion 43 is formed on the inner surface 41 and defines a storage space 431 with respect to the inner surface 41. On the outer surface 42 is disposed a puller 44. One end of the covering board 40 is a pivoting end 45 which is pivoted to the two pivots 343 in the assembling hole 34, and another end of the covering board 40 is an opening and closing end 46 along the edge of which are arranged a plurality of magnetic members 461. When the covering board 40 is closed to seal the receiving space 35, the storage portion 43 will be received in the receiving space 35 in such a manner that the edge of the opening and closing end 46 abuts against the edge of the top surface 33, and the magnetic members 331 and 461 are attracted together.

The armrest 14 is disposed on the top surface 33, and the storage device 20 is fixed to the lateral side of the seat 11 by the assembling frame 30 and the covering board 40, so that the space between the armrest 14 and the seat 11 can be utilized for storage purpose.

Figure 4:
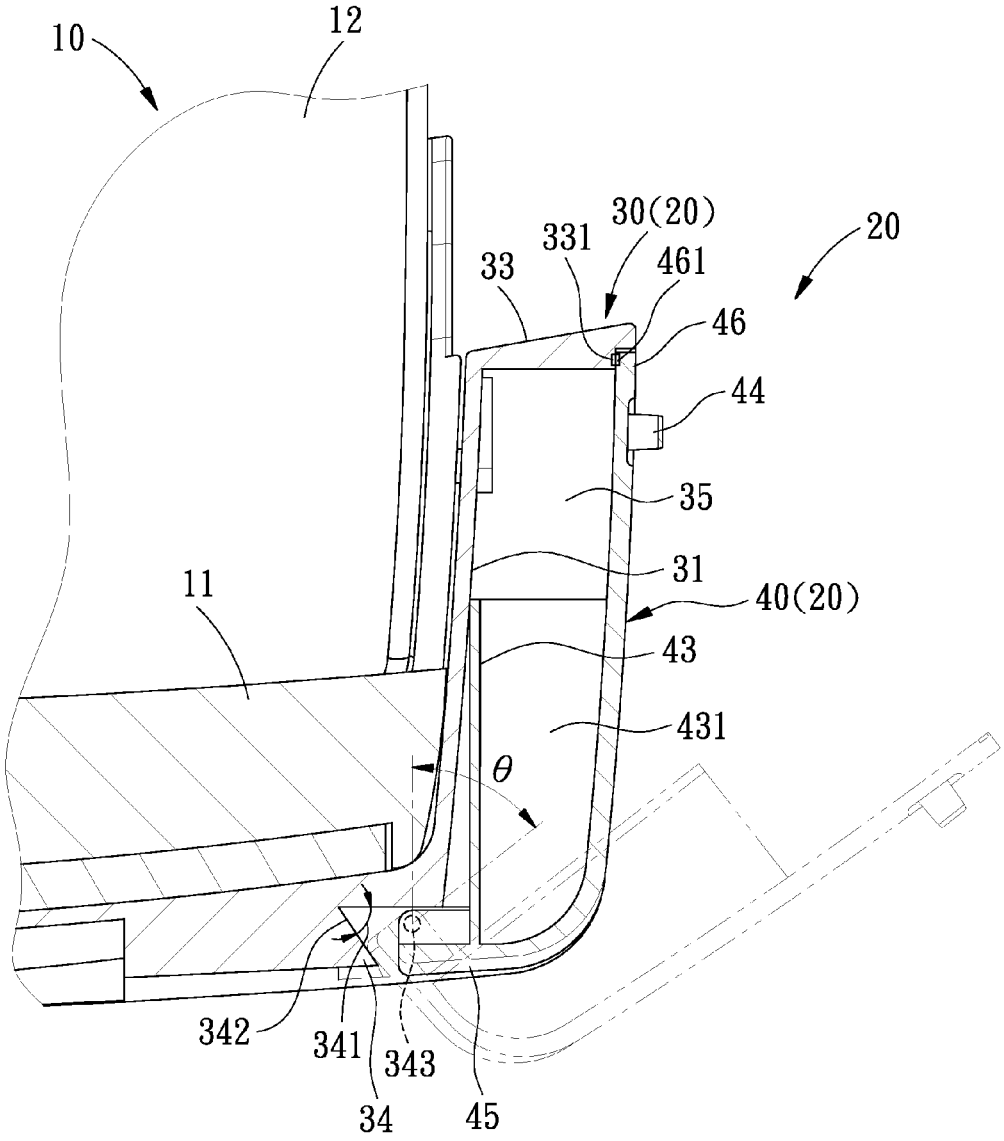
FIG. 4 is a cross sectional view showing that the puller in accordance with the first embodiment of the present invention protrudes out of the outer surface of the covering board.

For a better understanding of the present invention, its operation and function, reference should be made to FIGS. 3 and 4 again. When the covering board 40 pivots outward, the pivoting end 45 will pivot into the angle 341 until it abuts against the slanting surface 342 of the angel 341, which stops further pivoting of the covering board 40, so that a pivoting angle θ of the covering board 40 with respect to the assembling frame 30 won't be too large and will be close to the angle 341, thus preventing the disengagement of the covering board 40.

The puller 44 on the outer surface 42 of the covering board 40 is a reverse U-shaped structure to be gripped by the user to open or close the covering board 40. The magnetic members 331 and 461 at the edge of the opening and closing end 46 and that of the top surface 33 are attracted to one another, so that when the covering board 40 is closed, it can be positioned on the frame 30. The storage portion 43 on the inner surface 41 of the covering board 40 is a three-wall structure connected to the covering board 40 to define the storage space 431 for storing objects.

Figure 5:
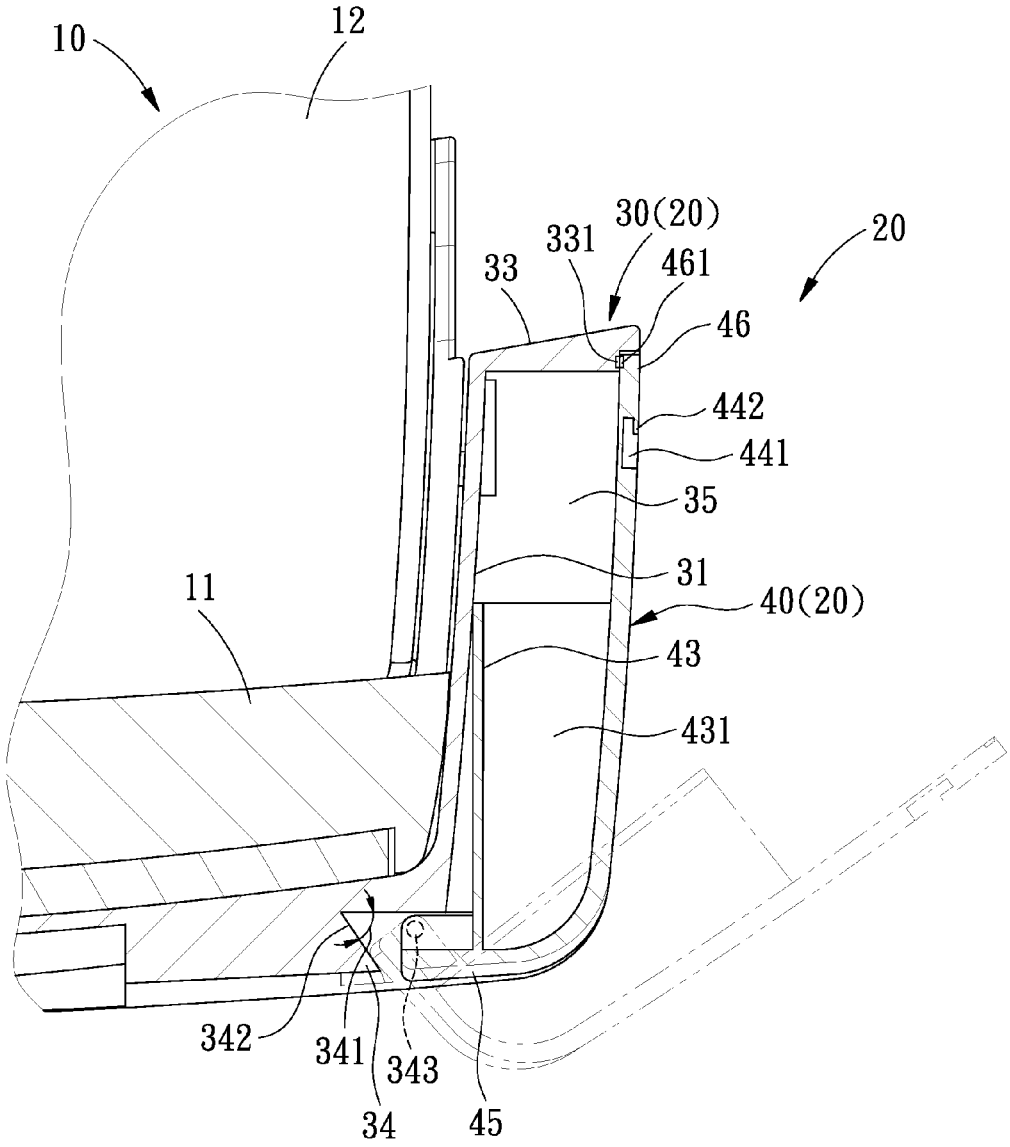
FIG. 5 is a cross sectional view showing that the puller in accordance with a second embodiment of the present invention takes the form of a concave portion and a stop edge which are embedded in the outer surface of the covering board.
Figure 6:
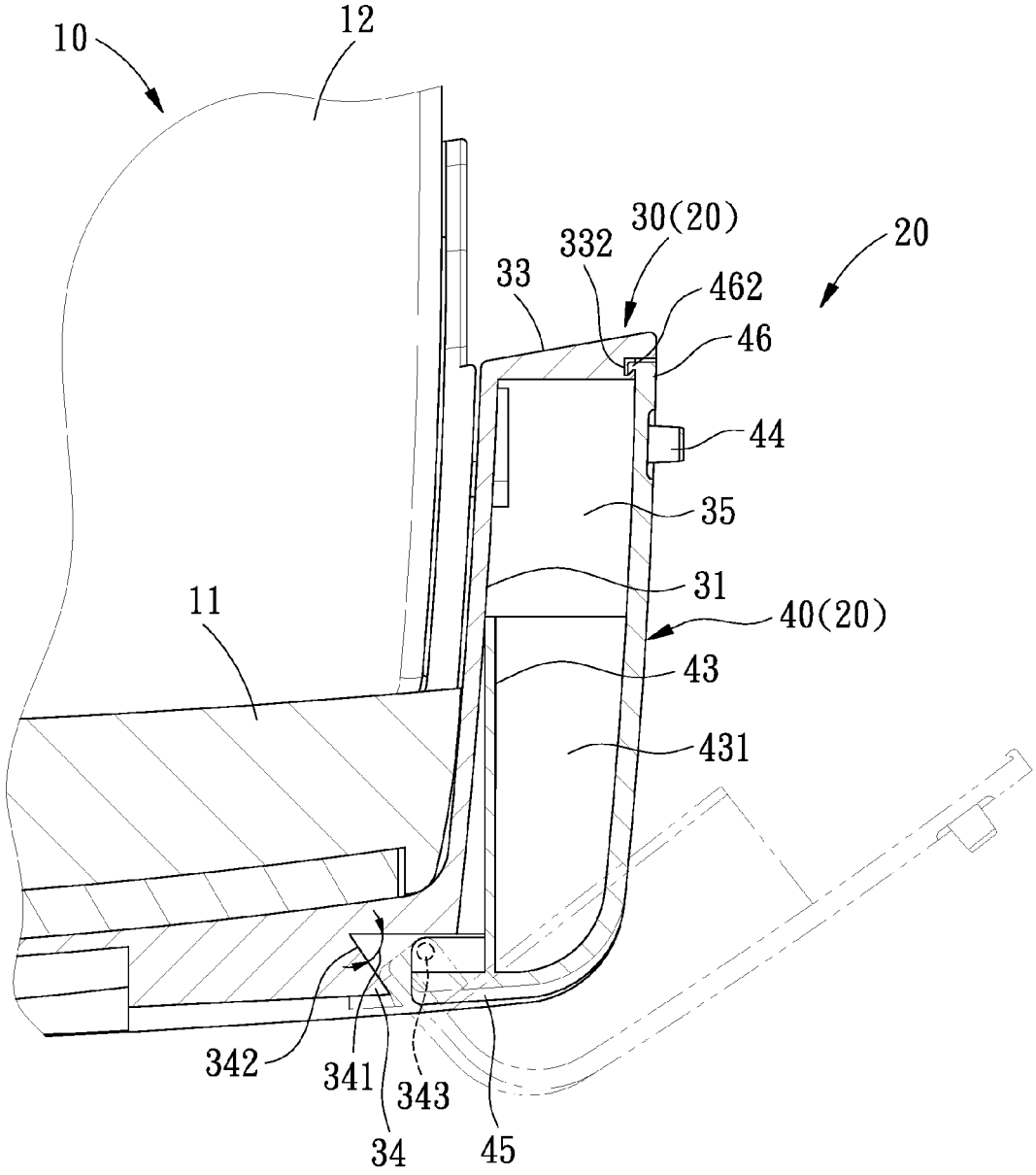
FIG. 6 shows the second embodiment of the present invention wherein a hook portion is formed on the covering board for engaging with an engaging groove in the assembling frame.

Referring then to FIGS. 5 and 6, another embodiment of the present invention is shown and similar to the previous embodiment except that: the puller 44 is embedded in the outer surface 42 of the covering board 40 and includes a concave portion 441 and a stop edge 442 (as shown in FIG. 5). The user's fingers can insert into the concave portion 441 and open the covering board 40 by pulling the stop edge 442. On the edge of the opening and closing end 46 is formed a hook portion 462 for engaging with an engaging groove 332 in the edge of the top surface 33 (as shown in FIG. 6), so that when the covering board 40 is closed, it can be positioned on the frame 30.

While we have shown and described various embodiments in accordance with the present invention, it is clear to those skilled in the art that further embodiments may be made without departing from the scope of the present invention.

What is claimed is:

1. An armchair with a storage device comprising:

a main body including a seat, a back and a base;

at least one storage device including at least one assembling frame and at least one covering board;

the assembling frame being disposed at a lateral side of the seat and including a bottom and sidewalls at both sides of the bottom, the assembling frame having two ends, at one end of the assembling frame being formed a top surface which is connected between the ends of the two sidewalls; another end of the assembling frame being formed with an assembling hole located between the two sidewalls, the bottom, the two sidewalls and the top surface defining a receiving space;

the covering board having one end formed with a pivoting end which is pivoted in the assembling hole, and another end of the covering board being formed with an opening and closing end, the receiving space is sealed with the covering board, an edge of the opening and closing end of the covering board abuts against that of the top surface of the assembling frame;

at least one armrest disposed on the top surface of the assembling frame, and the storage device is fixed to the lateral side of the seat by the assembling frame and the covering board, so that a space between the armrest and the seat is utilized for storage purpose;

an angle formed in the assembling hole, and one side of the angle is formed with a slanting surface, two pivots are formed in the assembling hole and located at two opposite inner surfaces of the sidewalls, the pivoting end of the covering board is pivoted to the two pivots in the assembling hole.

2. The armchair with a storage device as claimed in claim 1, wherein the base includes a plurality of radially-arranged legs, each of the legs is provided with a wheel.

3. The armchair with a storage device as claimed in claim 1, wherein the covering board includes an inner surface and an outer surface, a storage portion is formed on the inner surface and defines a storage space with respect to the inner surface of the covering board, the storage portion is received in the receiving space when the covering board is closed.

4. The armchair with a storage device as claimed in claim 1, wherein a puller is disposed on an outer surface of the covering board.

5. The armchair with a storage device as claimed in claim 1, wherein a concave portion and a stop edge are formed in an outer surface of the covering board.

6. The armchair with a storage device as claimed in claim 1, wherein a plurality of magnetic members are disposed along a periphery edge of the top surface of the assembling frame and along an edge of an opening and closing end of the covering board, and the magnetic members of the opening and closing end and the top surface are attracted to one another, so that when the covering board is closed, it is positioned on the frame.

7. The armchair with a storage device as claimed in claim 1, wherein a hook portion is formed on an edge of the opening and closing end of the covering board for engaging with an engaging groove in an edge of the top surface of the frame, so that when the covering board is closed, it is positioned on the frame.

* * * * *